US007228087B2

(12) United States Patent
Nagase

(10) Patent No.: US 7,228,087 B2
(45) Date of Patent: Jun. 5, 2007

(54) FIXING UNIT WITH AIR BLOWING APPARATUS

(75) Inventor: Hisayoshi Nagase, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/256,831

(22) Filed: Oct. 24, 2005

(65) Prior Publication Data

US 2006/0140662 A1 Jun. 29, 2006

(30) Foreign Application Priority Data

Dec. 27, 2004 (JP) ..... 2004-376308

(51) Int. Cl.
*G03G 21/20* (2006.01)

(52) U.S. Cl. ..... 399/92; 399/334

(58) Field of Classification Search ..... 399/92
See application file for complete search history.

(56) References Cited

U.S. PATENT DOCUMENTS 3,941,471 A * 3/1976 Schatka et al. ..... 399/91
2002/0186986 A1* 12/2002 Makihira ..... 399/92

FOREIGN PATENT DOCUMENTS

| | | | |
|---|---|---|---|
| JP | 04-051179 | | 2/1992 |
| JP | 04051179 A | * | 2/1992 |
| JP | 05-107983 | | 4/1993 |
| JP | 2003-020149 | | 1/2003 |

* cited by examiner

*Primary Examiner*—David M. Gray
*Assistant Examiner*—Bryan Ready
(74) *Attorney, Agent, or Firm*—Cantor Colburn LLP

(57) ABSTRACT

An image forming apparatus provided with a fixing unit, the fixing unit comprising: a fixing member having a heating member therein; a pressing member that presses against the fixing member, wherein an image supporting material carrying a toner image is grasped and conveyed by a nipping portion formed between the fixing member and the pressing member and the toner image is fixed by applying heat and pressure at the nipping portion; an air blowing section provided downstream of the nipping portion on a conveying path of the image supporting material; and an air flow path switching section that switches an air blow of the air blowing section in accordance with a size of the image supporting material for both ends of the conveying path and for both ends of the fixing member.

4 Claims, 2 Drawing Sheets

FIXING UNIT WITH AIR BLOWING APPARATUS

This application is based on Japanese Patent Application No. 2004-376308 filed on Dec. 27, 2004, which is incorporated hereinto by reference.

BACKGROUND OF THE INVENTION

An embodiment of the present invention relates to an image forming apparatus that eliminates problems such as rubbing marks caused by oozing of wax that occurs during the cooling of a fixing unit installed in an image forming apparatus using toners that include wax.

A fixing unit installed in an image forming apparatus is provided with a mechanism that carries out fixing by heating while nipping and conveying the image supporting material which is the transfer material having the transferred image on it using, for example, a heat roller as the fixing member and using, for example, a pressure roller as the pressing member that presses against and is in contact with the heat roller.

Further, related to such fixing units:

Firstly, regarding the edge part temperature rise of heating sections such as the heat roller in a fixing unit, at the time of fixing sheets with small sizes, although there is the problem that the fixing temperature of parts through which the paper does not pass rises excessively, the technique of forced air cooling selectively the edge parts of the fixing apparatus is present as a conventional technology, as disclosed in Japanese Unexamined Patent Application Laid Open No. Hei 4-51179 and Japanese Unexamined Patent Application Laid Open No. Hei 5-107983.

Secondly, when using toners that include wax, regarding the conveyance rubbing marks occurring on the downstream side of the fixing unit, although wax oozes out on the surface of a fixed image of a toner that includes wax, there is the trend of the glossiness of the wax increasing if cooled suddenly near the crystallization temperature and of the glossiness of the wax decreasing if cooled slowly. As a consequence, the image rubs against conveying rollers and guiding members on the downstream side of the fixing unit, and rubbing marks remain upon sudden cooling. In order to prevent this, although there is the technique, as disclosed in Japanese Unexamined Patent Application Laid Open No. 2003-20149, of installing the roller pairs at a separation on the downstream side of fixing, paper rubs against the rollers due to the behavior of the sheets and marks are formed on them. In addition, since conveying force cannot be generated, there will be limitations on the conveying path. In view of this, air is blown and slow cooling (or fast cooling) is done immediately after fixing.

Patent Document 1: Japanese Unexamined Patent Application Laid Open No. Hei 4-51179.

Patent Document 2: Japanese Unexamined Patent Application Laid Open No. Hei 5-107983.

Patent Document 3: Japanese Unexamined Patent Application Laid Open No. 2003-20149.

In this manner, in an image forming apparatus using toners that include wax, in order to solve the above problems, at least two systems of air blowing unit were required in a conventional fixing unit, and hence the apparatus became large in size and higher in cost.

SUMMARY OF THE INVENTION

One of the embodiments of the present invention may provide a small-space low-cost image forming apparatus with a simplified construction, when using a toner that includes wax, by solving the problems of conventional fixing unit of the above type, by carrying out appropriately and without wastage using a single air blower the air blowing for appropriate cooling of the fixing members such as the heat roller or the endless heating belt of the fixing unit, and the air blowing to the downstream side inside the fixing unit immediately after fixing by applying heat and pressure, so that, depending on the size of the image supporting material, the path of the air blow is changed appropriately and the fixing operation is carried out in a stable manner.

In addition, another embodiment of the present invention may provide an image forming apparatus that not only eliminates the dirt of traces of adhesion left by the melted part associated with oozing of toner having wax on the conveying path after the nipping portion and on the guide rollers, but also eliminates variations in glossiness caused in the image, and hence forms images with a stable high image quality.

These embodiments may be achieved by the following technical structure.

In an image forming apparatus with a fixing unit that carries-out fixing of the image by applying heat and pressure after grasping and conveying the image supporting body on which a toner image has been carried using the nipping portion of a fixing member provided with a heating member and a pressing member that presses against it, the image forming apparatus has the following: an air blowing section provided on the conveying path along the downstream side of the nipping portion; and an air flow path switching section that changes the air blow of the air blowing section in accordance with the size of the image supporting body for the both ends of the conveying path and for the both ends of the fixing member.

BRIEF DESCRIPTION OF THE DRAWINGS

Embodiments will now be described, by way of example only, with reference to the accompanying drawings which are meant to be exemplary, not limiting, and wherein like elements are numbered alike in several FIGS. in which.

DETAILED DESCRIPTION OF THE PREFERRED EMBODIMENT

A preferred embodiment of the present invention is described below. Further, the descriptions given here shall not be construed to limit the technical scope of the claims or the meanings of the technical terms. In addition, in the following, the assertive explanations of the preferred embodiment of the present invention merely indicate the best mode and shall not be construed to limit the meanings of technical terms or the technical scope of an emobodiment of the present invention.

Further, although the explanations given here assume a heat roller as the fixing member and a pressing roller as the pressing member of the fixing apparatus used in an embodiment the present invention, it goes without saying that it is also possible to use an endless heated belt as the fixing member and to use any item other than a pressing roller as the pressing member.

Figure 1:
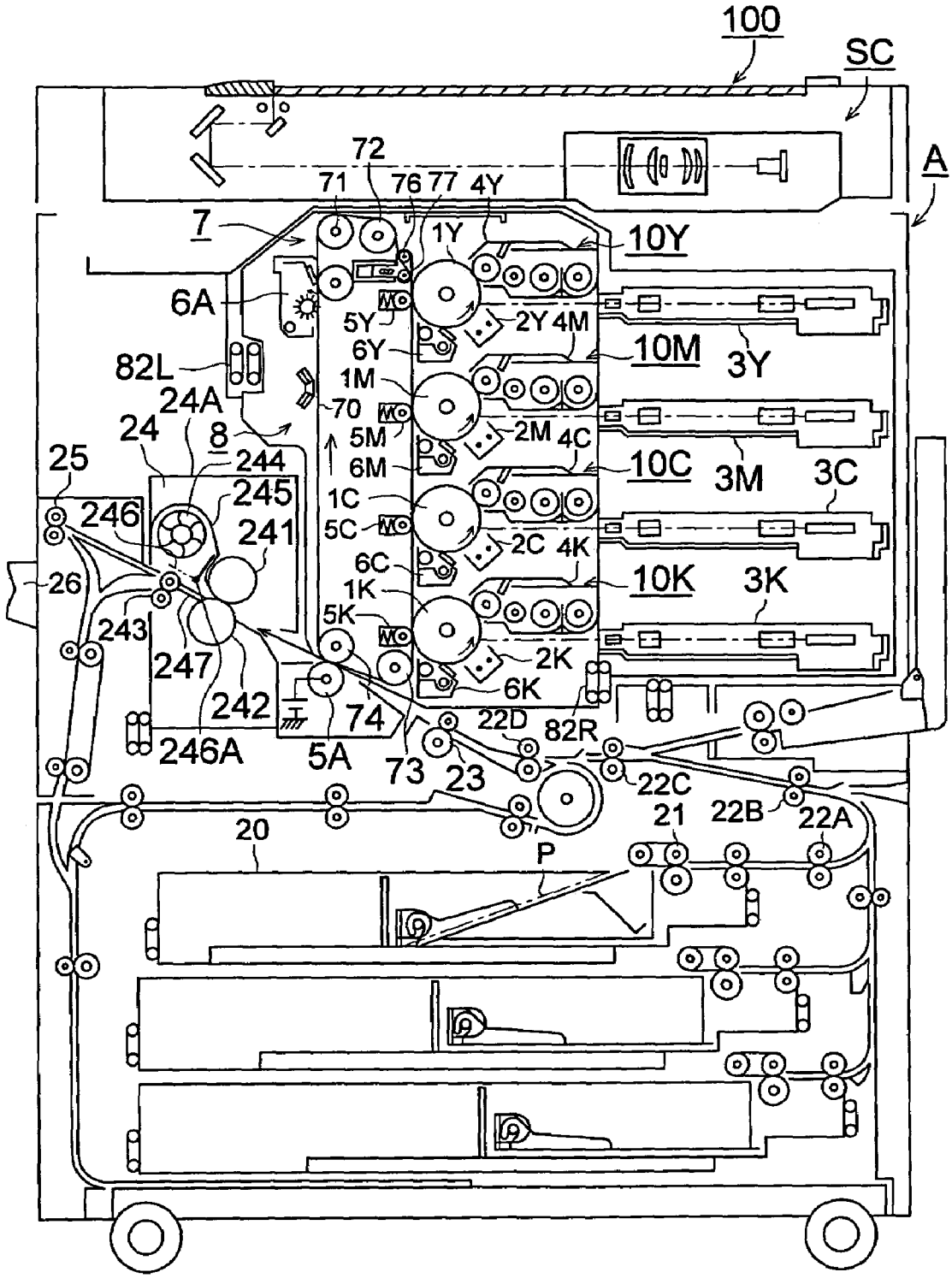
FIG. 1 is an outline configuration diagram showing an image forming apparatus for color as a preferred embodiment of the present invention.

FIG. 1 is an outline configuration diagram showing a color image forming apparatus as a preferred embodiment of the present invention.

This image forming apparatus 100 is of the so-called full color image forming apparatus type of the tandem configuration, and has four sets of image forming sections 10Y, 10M, 10C, and 10K, an endless belt shaped intermediate image transfer body unit 7, a sheet feeding unit 21, and a fixing unit 24. The original document reading apparatus SC is disposed on top of the main unit A of the image forming apparatus.

The image forming section 10Y that forms images of yellow color has a drum shaped photoreceptor 1Y, a charger 2Y placed around the drum shaped photoreceptor 1Y, an imagewise exposure unit 3Y, a developing unit 4Y, a primary transfer roller 5Y as a primary transfer unit, and a cleaning unit 6Y. The image forming section 10M that forms images of magenta color has a drum shaped photoreceptor 1M, a charger 2M placed around the drum shaped photoreceptor 1M, an imagewise exposure unit 3M, a developing unit 4M, a primary transfer roller 5M as a primary transfer unit, and a cleaning unit 6M. The image forming section 10C that forms images of cyan color has a drum shaped photoreceptor 1C, a charger 2C placed around the drum shaped photoreceptor 1C, an imagewise exposure unit 3C, a developing unit 4C, a primary transfer roller 5C as a primary transfer unit, and a cleaning unit 6C. The image forming section 10K that forms images of black color has a drum shaped photoreceptor 1K, a charger 2K placed around the drum shaped photoreceptor 1K, an imagewise exposure unit 3K, a developing unit 4K, a primary transfer roller 5K as a primary transfer unit, and a cleaning unit 6K.

An endless belt shaped image intermediate transfer body unit 7 is entrained about a plurality of rollers, and has an endless belt shaped intermediate image transfer body 70 which acts as an intermediate image transfer body in the shape of a partially conducting endless belt which is supported in a freely rotatable manner.

The images of different colors formed by the image forming section 10Y, 10M, 10C, and 10K, are successively transferred onto the rotating endless belt shaped intermediate image transfer body 70 by the primary transfer rollers 5Y, 5M, 5C, and 5K, thereby forming the synthesized color image. The transfer material P as the recording media stored inside the sheet feeding cassette 20 is fed from the sheet feeding unit 21, pass through a plurality of intermediate rollers 22A, 22B, 22C, and 22D, and the registration roller 23, and is conveyed to the secondary transfer roller 5A which functions as the secondary image transfer unit, and a color image is transferred concurrently onto the transfer material P. The transfer material P on which the color image has been transferred is subjected to fixing process by the fixing unit 24, and is gripped by the sheet discharge rollers 25 and ejected onto the sheet discharge tray 26 outside the apparatus.

On the other hand, after the color image is transferred to the transfer material P by the secondary transfer roller 5A functioning as the secondary transfer unit, the endless belt shaped intermediate image transfer body 70 from which the transfer material P has been separated due to small radii of curvature is cleaned by the cleaning unit 6A to remove all residual toner on it.

During image forming, the primary transfer roller 5K is pressing against the photoreceptor 1K at all times. Other primary transfer rollers 5Y, 5M, and 5C come into pressure contact respectively with their corresponding photoreceptors 1Y, 1M, and 1C only during color image forming.

The secondary transfer roller 5A comes into pressure contact with the endless belt shaped intermediate transfer body 70 only when secondary transfer is to be made by passing the transfer material P through the above roller.

Further, the frame 8 can be pulled out via the supporting rails 82L and 82R from the apparatus body A.

The frame 8 has the image forming sections 10Y, 10M, 10C, and 10K, and the endless belt shaped intermediate image transfer body unit 7.

The image forming sections 10Y, 10M, 10C, and 10K are arranged in column in the vertical direction. The endless belt shaped intermediate image transfer body unit 7 is arranged to the left side in the figure of the photoreceptors 1Y, 1M, 1C, and 1K. The endless belt shaped intermediate image transfer body unit 7 has the endless belt shaped intermediate image transfer body 70 that can be entrained about the rollers 71, 72, 73, 74, 76, and 77 the primary image transfer rollers 5Y, 5M, 5C, and 5K, and the cleaning unit 6A.

By the pulling out operation of the frame 8, the image forming sections 10Y, 10M, 10C, and 10K, and the endless belt shaped intermediate image transfer body unit 7 are pulled out from the apparatus body A as an integral unit.

In this manner, the toner image is formed on the photoreceptors 1Y, 1M, 1C, and 1K by charging, exposure, and development, the toner images of different colors are superimposed on the endless belt shaped intermediate image transfer body 70 by primary image transfer, and all these toner images together are secondary transferred onto the transfer material P, and fixed in the fixing unit 24 by applying pressure and heat. The photoreceptors 1Y, 1M, 1C, and 1K, after the toner image is transferred onto the endless belt shaped intermediate image transfer body 70, are cleaned by cleaning units 6Y, 6M, 6C, and 6K to remove the toners remaining on each of the photoreceptors during image transfer, and then the next image is formed by entering the above cycles of charging, exposure, and development.

In this embodiment of the present invention, each of the photoreceptors 1Y, 1M, 1C, and 1K is an OPC (organic photoconductor) with a diameter of 60 mm, the developer is a two-component developer including a toner and a carrier, and the toner is one that includes wax in it. The processing speed is 220 mm/s, and an endless belt shaped intermediate image transfer body 70 has been incorporated as the intermediate image transfer body in this image forming apparatus which is a full color image forming apparatus 100 of the tandem type of configuration.

Figure 2:
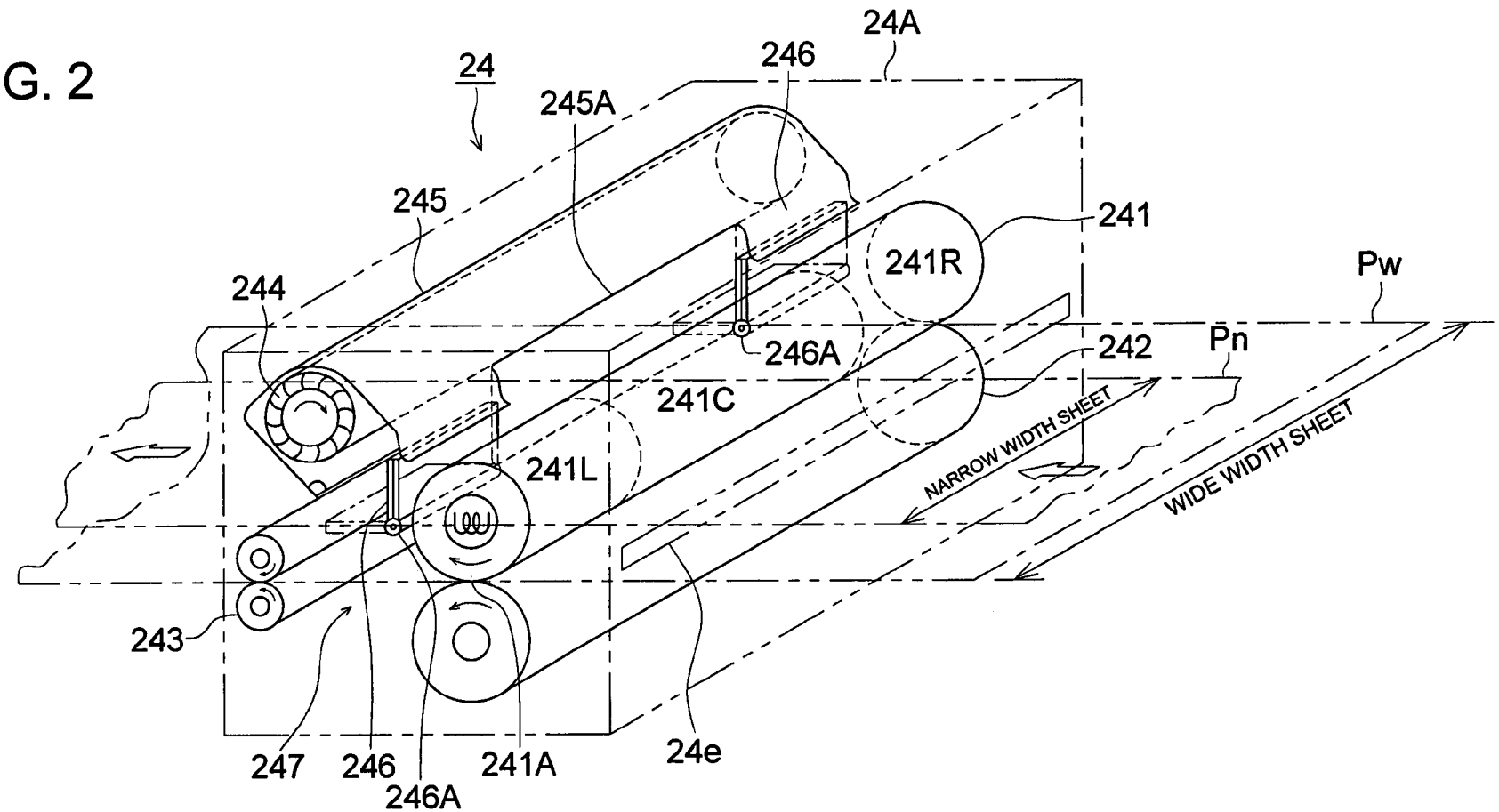
FIG. 2 is a perspective view diagram showing schematically the fixing unit installing in an image forming apparatus according to an embodiment of the present invention.

Further, although the fixing unit 24 employs a heat roller 241 as the fixing member and a pressure roller 242 as the pressing member as described above, an embodiment of the present invention is not limited to these. The fixing unit 24, as is shown in FIG. 2 which is a perspective view diagram showing schematically the fixing unit installed in an image forming apparatus according to an embodiment of the present invention, has placed in it the heat roller 241 the upper part inside the chassis 24A, the pressing roller 242 that presses up the heat roller 241 from below, the inlet guide 24e through which the transfer material P as the image supporting body enters the nipping portion 241A of the two rollers, the conveying path 247 which guides the transfer material P that has been nipped, heated, and pressed, and the guide roller 243 near the outlet. Further, a cross flow fan is provided inside the chassis 245 as the air blower 244 diagonally above the transfer path 247 and the heat roller 241. This chassis 245 is fully opened toward the conveying path 247, and toward the heat roller 241 it is opened to the end parts 241L and 241R excepting the central part 241C which is shut off by the wall 245A of the chassis. Also, an air flow path switching section 246 is provided, this air flow path switching section 246 is rotated on the shaft 246A between both ends of the heat roller 241 and both ends of the conveying path 247, so that the switching can be made according to the size of the transfer material P.

In the fixing unit 24, the direction of airflow is changed toward the part at the both ends over which the sheet does not pass when the transfer material Pn as an image supporting material of a smaller size is being conveyed in the conveying path 247 on the downstream side of the nipping portion 241A that heats and presses the transfer material P as the image supporting material, so as to send the cooling air to the end parts 241L and 241R of the heat roller 241 of the fixing unit 24 over which the sheet does not pass, thereby unifying the air blow unit as a single system. Therefore, it is possible to suppress the size of the fixing unit 24 from becoming large and its cost from becoming high.

The heat roller 241 of the fixing unit 24 is a roller having a heater inside it such as an induction heating type or a halogen lamp type heater, and the pressing roller 242 presses against it to form the nipping portion 241A.

The length of the above rollers has been set to a size that makes it possible to process sufficiently the horizontal length of the transfer material P normally using an image supporting material of A3 size. Also, the image supporting material that is processed includes the wide A3 sized one above and a narrow one with a horizontal width of B5 sized sheet or less. Such an image supporting material is gripped and conveyed by the nipping portion of the two rollers, passes through the pair of guide rollers 243 at the center of the conveying path 247, is placed on the sheet discharge tray 26. However, the large and small sizes need not be limited to the above examples.

The heat roller 241 has, as has been described above, the central section 241C, and the both end sections 241L and 241R, and since there is provided internally a heating member that heats the heated member uniformly, when a transfer material Pn of a small width comes, the heat is taken out in the central section 241C by the transfer material Pn and that part gets cooled and although a constant fixing temperature is maintained, there is almost no heat taken out from the regions of the end parts 241L and 241R and hence will reach a high temperature if left as it is and when the width of the sheet is changed to a large width the status will no longer be that of a uniformly constant temperature.

On the other hand, although the large width and small width transfer materials Pw and Pn that are heated and pressed in the nipping portion are conveyed by the conveying path 247 and the guide roller 243 via the center of the chassis 24A of the fixing unit 24 toward the downstream side and are placed on the sheet discharge tray 26, when a toner including wax is used, due to the effect of melting of the wax if the fixing is done at that fixing temperature, and since this not only makes dirty the conveying path due to the adhesion of wax traces but also since there will be variations in the glossiness of the image, it is necessary to eliminate the effect of oozing of the wax at least by sending an air blow irrespective of the width of the size of the transfer material P.

However, in the case of transfer material Pn of small width, although it is sufficient if air blow is sent at least only to the part corresponding to the small width, in the case of transfer material Pw of large width, it is necessary that the air blow reaches the entire width of the transfer material Pw.

In this manner, it is not only necessary to correspond to any change in the size of the transfer material at any time by maintaining the heating member to have a uniform temperature distribution at all times, but also to send sufficient air flow to the downstream side as a measure to correspond to toners that include wax, so that there is no leaving traces on and dirtying of the conveying path or guide roller or generation of variation in the glossiness of the image due to the wax remaining in the molten state without being cooled. This condition is being satisfied and, without providing many air blowers as in conventional methods, and sufficient effect is obtained in an embodiment of the present invention by using only one air blower and switching the air flow path suitably according to the size of the transfer material P.

In other words, when fixing a transfer material Pn of small size, the air flow path switching section 246 operates so that the regions at the both end sections 241L and 241R of the heat roller 241 are opened and the both end parts of the conveying path 247 are closed. Also, when fixing a transfer material Pw of large size, the air flow path switching section 246 operates so that the regions at the both end sections 241L and 241R of the heat roller 241 are closed and the both end parts of the conveying path 247 are opened, and hence the entire air flow path is closed for the heat roller 241 and the entire air flow path is opened for the conveying path 247.

According to an embodiment of the present invention, the air flow path switching section is switched when using an image supporting material of small size thereby forming air flow paths at the both end sections of the fixing member such as a heat roller or an endless heat belt, the efficiency is increased by shutting off unnecessary air flow path at the both end sections of the conveying path in the downstream side of the nipping portion inside the fixing unit, when using an image supporting material of large size, the air flow path switching section is switched, the air flow path in the entire region of the fixing member is shut off, the necessary air flow path is formed in the entire conveying path on the downstream side of the nipping portion inside the fixing unit, and, irrespective of the size of the image supporting material, not only uniformity of the fixing temperature is achieved, but also the problems of leaving traces on and dirtying of the conveying path or guide roller or of generation of variation in the glossiness of the image due to the wax remaining in the molten state without being cooled, and hence it has been made possible to maintain high image quality in a stable manner. Furthermore, since the realization of such a function has been made possible using only one air blowing unit using a switching section of the direction of air flow, the fixing unit does not become big in size but becomes compact, does not take up much space, and also it is possible to reduce the cost of manufacture.

While the preferred embodiments of the present invention have been described using specific terms, such description is for illustrative purposes only, and it is to be understood that changes and variations may be made without departing from the spirit or scope of the appended claims.

What is claimed is:

1. An image forming apparatus provided with a fixing unit, comprising:

(a) a fixing member having a heating member;

(b) a pressing member that presses against the fixing member, wherein an image supporting material carrying a toner image is grasped and conveyed by a nipping portion formed between the fixing member and the pressing member and the toner image is fixed by applying heat and pressure at the nipping portion;

(c) an air blowing section provided downstream of the nipping portion in a sheet conveyance direction and above a conveying path of the image supporting material, which sends an air blow toward an entire width of the conveyance path; and (d) an air flow path switching section that switches between a first position at which the air blow in both ends areas of the air blowing section is sent toward both ends areas of the fixing member, and a second position in which the air blow in both of the ends areas of the air blowing section is sent toward both ends areas of the conveying path of the image supporting material.

2. The image forming apparatus of claim 1, wherein the air flow path switching section is rotated on a shaft.

3. The image forming apparatus of claim 1, wherein both of the ends areas of the conveying path of the image supporting material are areas excluding an area where a small size of the image supporting material passes.

4. The image forming apparatus of claim 1, wherein air flow path switching section switches between the first and second positions according to a size of the image supporting material.

* * * * *